US005398728A

United States Patent [19]

Baumeister et al.

[11] Patent Number: 5,398,728

[45] Date of Patent: Mar. 21, 1995

[54] VOLUME FLOW REGULATOR FOR AIR CONDITIONING AND VENTILATION APPARATUS

[75] Inventors: Gregor Baumeister, Krefeld; Manfred Sadkowski, Geldern, both of Germany

[73] Assignee: Gebruder Trox Gesellschaft Mit Beschrankter Haftung, Neukirchen-Vluyn, Germany

[21] Appl. No.: 80,437

[22] Filed: Jun. 21, 1993

[30] Foreign Application Priority Data

Jun. 23, 1992 [DE] Germany ..... 9208345 U

[51] Int. Cl.[6] ..... F15D 1/02

[52] U.S. Cl. ..... 138/37; 137/499

[58] Field of Search ..... 137/499; 138/38, 39, 138/45, 46, 37; 454/333, 334, 358, 361

[56] References Cited

U.S. PATENT DOCUMENTS

| | | | |
|---|---|---|---|
| 2,581,748 | 1/1952 | Blum | 137/499 |
| 2,850,043 | 9/1958 | Samuelson | 138/45 |
| 4,098,296 | 7/1968 | Grasso | 138/46 |
| 4,190,085 | 2/1980 | Hasa | 138/46 |
| 4,289,161 | 9/1981 | Siegwart | 137/499 |
| 4,523,609 | 6/1985 | Week | 137/499 |
| 4,633,900 | 1/1987 | Suzuki | 138/46 |

FOREIGN PATENT DOCUMENTS

| | | | |
|---|---|---|---|
| 185934 | 10/1984 | Japan | 459/333 |

*Primary Examiner*—David A. Scherbel
*Assistant Examiner*—Terrence R. Till
*Attorney, Agent, or Firm*—Herbert Dubno; Andrew Wilford; Yuri Kateshov

[57] ABSTRACT

A volume flow controller for air conditioning and ventilation apparatus which has a pivotable flap in a flow duct whose pivot shaft has a lever arm and which is articulated to a spring. To provide a mechanically self-actuating volume flow controller, in which the spring is matched to the control process by a simple adjustment, the spring is a leaf spring whose one end is connected with a lever and whose other end is so fastened on a cam disk that upon adjustment of the cam disk about a rotation point, the leaf spring is entrained by the cam disk and rolls on the curve thereof. A device is provided for fixing the cam disk.

6 Claims, 3 Drawing Sheets

VOLUME FLOW REGULATOR FOR AIR CONDITIONING AND VENTILATION APPARATUS

SPECIFICATION

1. Field of the Invention

The invention relates to a volume flow regulator for air conditioning and ventilation apparatus having a flap swingable in a flow duct; and provided with a pivot shaft carrying a lever arm which is automatically connected to a spring.

More particularly, the invention relates to a flap type volume flow regulator or controller in which the flap is self-actuated, i.e. is positioned as a function of the flow through the duct, but the matching of the position of the flap to the particular requirements can be set for the specific duct and application of the regulator or controller in a simple manner.

2. Background of the Invention

Such volume flow regulators are known in various configurations. They operate mechanically automatically, because the flow-determined torque on the flap is compensated by the spring. Upon a change in the flow conditions there is also a change in the pivot position of the flap. A precondition for such systems is that the spring be specially calibrated for each regulator or controller.

OBJECTS OF THE INVENTION

It is the object of the invention to provide a mechanically self-regulating volume flow controller in which the spring can be matched to the control requirements by a simple adjustment.

Another object of the invention is to provide a self-positioning flap-type control for the volume flow regulation of air traversing a duct, especially for an air conditioning or ventilating apparatus, whereby drawbacks of earlier systems are obviated.

Another object is to provide a low cost simple and reliable control for air flow through a duct such that complex arrangements hitherto required for matching a spring force where the regulator or controller requirements can be eliminated.

SUMMARY OF THE INVENTION

This object is achieved by providing the spring as a leaf spring, one end of which is Connected to the lever while its other end is fastened on a cam disk, by adjusting the cam disk about a center of rotation to entrain the leaf spring with the cam disk and cause the leaf spring to roll on the curved surface of the cam, and by providing a device for fixing the position of the cam about its rotation point. To match the leaf spring to the particular controller it suffices, therefore, to rotate the cam disk about its rotation point until the leaf spring has attained the desired spring prestress. Thus, in general, both the spring constant and the direction of attack of the force can be altered.

It can be advantageous to provide a connecting bar or rod or a connecting wire or cable for connecting the lever with the juxtaposed end of the leaf spring. This expands the possibilities with respect to the possible structural configurations of the regulator or controller.

In a preferred embodiment of the invention, the leaf spring is oriented so as to be substantially orthogonal or perpendicular to the flow passage when the force applied by the flap thereto is relieved.

More particularly, a volume flow regulator for an air conditioning or ventilating apparatus can comprise:

a duct traversed by a flow of air;

a flap swingable in the duct and acted upon by the flow of air, whereby a torque on the flat is determined by the flow;

a flap shaft carrying the flap and rotatable on the duct;

a lever connected to the flap shaft;

a leaf spring having one end articulatedly connected to the lever and another end;

a cam pivotable about a pivot axis and having a curved surface, the other end being connected to the cam whereby the leaf spring rolls upon the curved surface upon rotation of the cam, thereby altering prestress on the leaf spring and a direction of force application thereto; and means for releasably fixing a position of the cam about the pivot axis.

BRIEF DESCRIPTION OF THE DRAWING

The above and other objects, features, and advantages will become more readily apparent from the following description, reference being made to the accompanying drawing in which.

SPECIFIC DESCRIPTION

Figure 3:
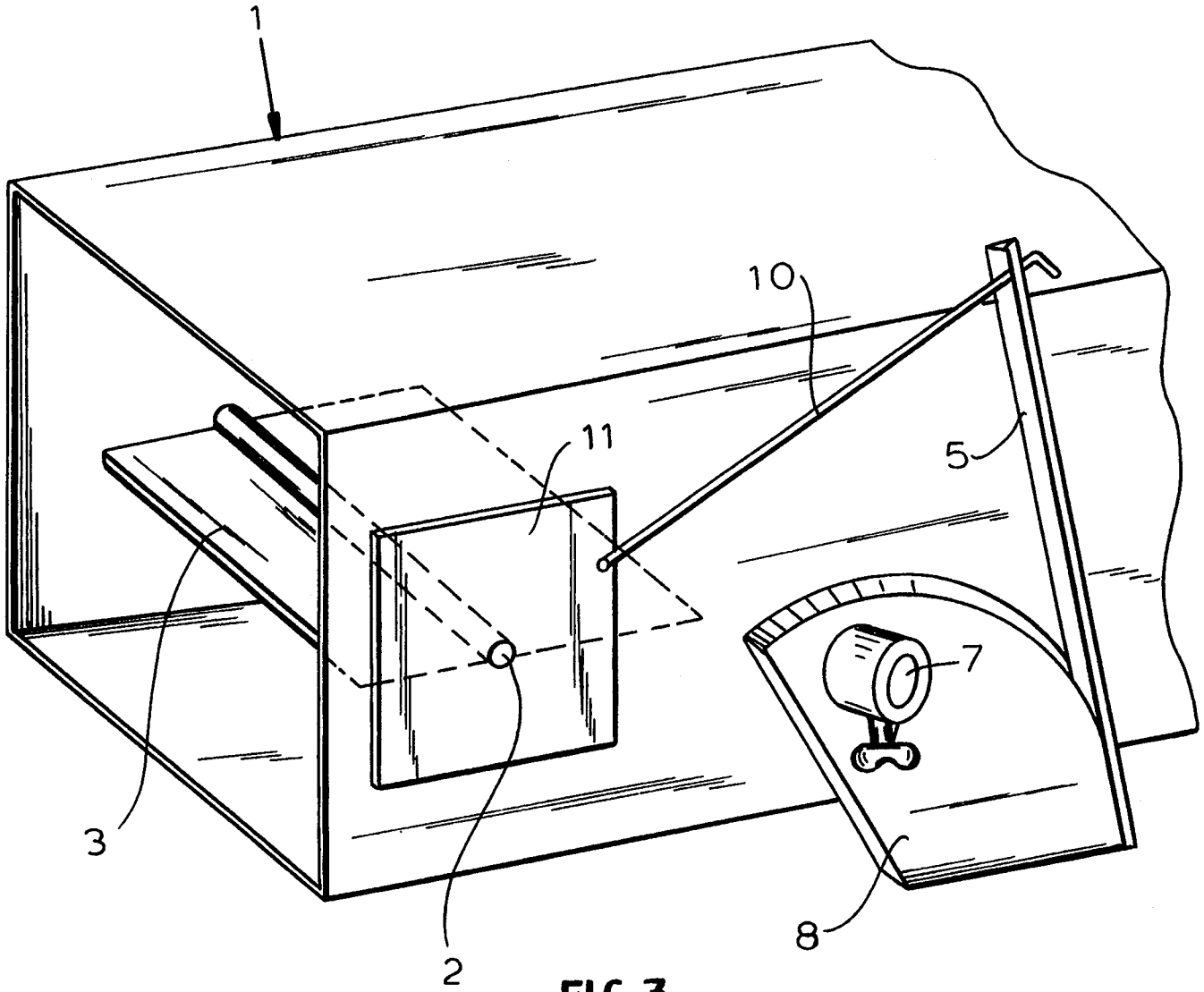
FIG. 3 is a perspective view according to the invention.

As is shown in FIG. 3 a duct 1 is provided with a housing, a passage for passing an air flow and receiving a flap 3 pivotal on a shaft 2 to control a cross section of the passage. Mounted outside the passage and on the housing of the duct are a plate or lever 11 mounted rotatably fixedly on a respective end of the shaft 2 and a means for adjustably controlling an angular position of the flap which includes a cam disk 2, spring 5 and a connecting bar 10. The flap (FIG. 1) is shown displaced from its original position given in broken lines and the effect of the flow forces of the air flow 6 against the effect of the spring 5 is represented by the swing in the direction of arrow 4. On the flow duct 1 the cam disk 8 is pivotable about a rotation point 7 and can be secured in different pivotal positions by a device described below. At the lower end of the curve 9 of the cam as shown in the drawing, the spring 5 is secured, the spring 5 being formed as a leaf spring. The other end of the spring 5 is articulatedly connected by the connecting bar or rod 10 or connecting cable with the lever 11 which is mounted on the pivot shaft 2 of the flap 3.

In solid lines, the relieved spring 5 is shown and extends substantially orthogonally to the flow duct 1. In dashed lines a functional position is represented in which the cam disk 8 is pivoted in the direction of the arrow 12 through a given angle. Upon such pivoting, the leaf spring 5 rolls on the curve 9 of the cam disk 8 so that the end of the leaf spring connected to the connecting bar 10 develops a curvature. This changes the spring constant, the prestress of the spring and the direction of attack of the force on lever 11.

If the characteristics of the controller are to be changed, the cam disk 8 can be released and adjusted to another position.

Figure 1:
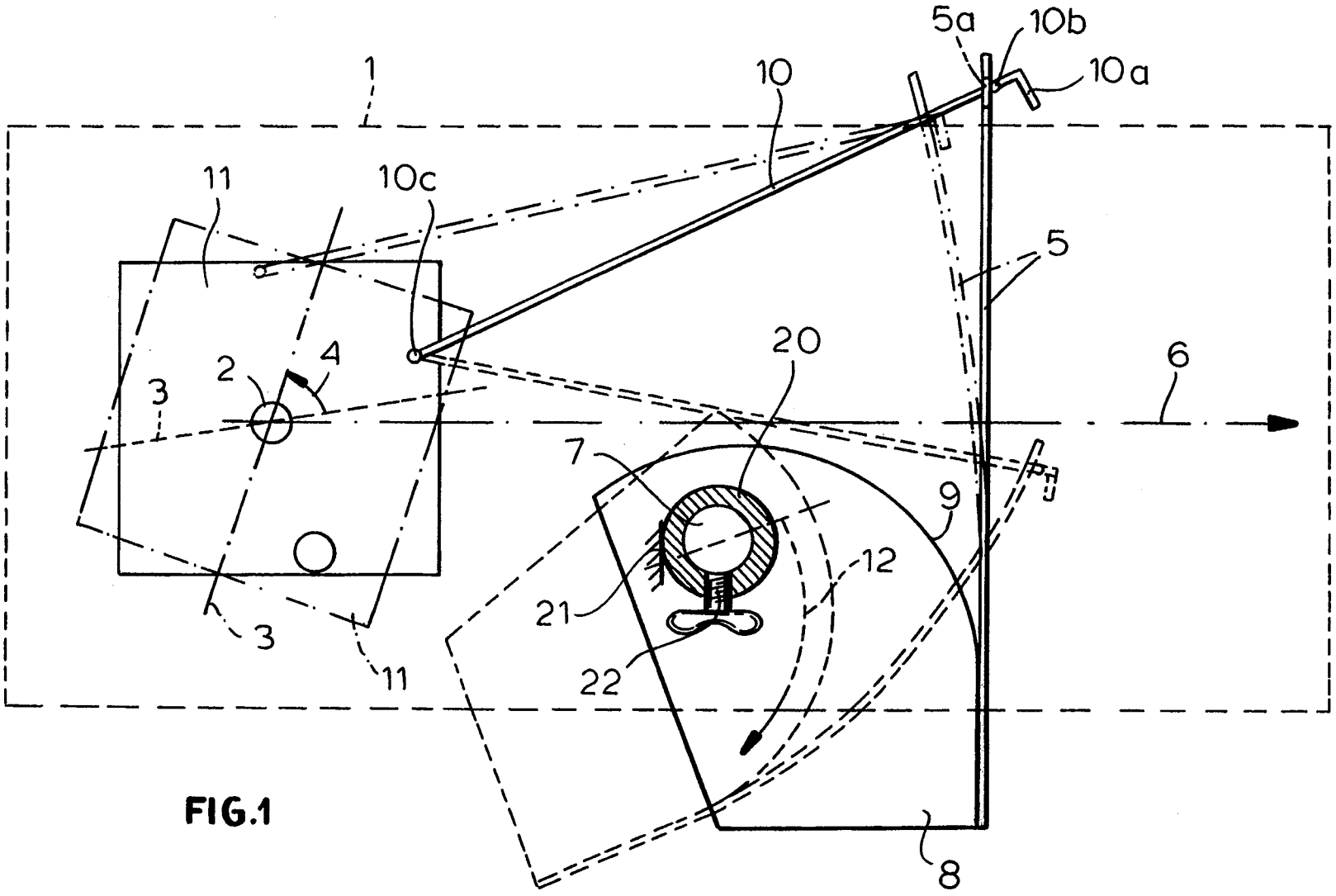
FIG. 1 is a diagrammatic plan view of a regulator for the flow of air through an air conditioning or ventilating duct according to one embodiment of the invention.

As can be seen in greater detail from FIG. 1, the means for securing the shaft 7 of the cam 6 in any of its selected angular positions ranging, say, from the position shown in solid lines in FIG. 1 to the broken line position shown, can include a sleeve 20 which is fixed relative to the duct 1 or to any other support as represented at 21, and into which a screw 22 is threaded so that, when the screw 22 is tightened, the shaft 7 will be held against rotation. When, however, the screw 22 is loosened, the cam 12 can be rotated in the manner described.

Figure 2:
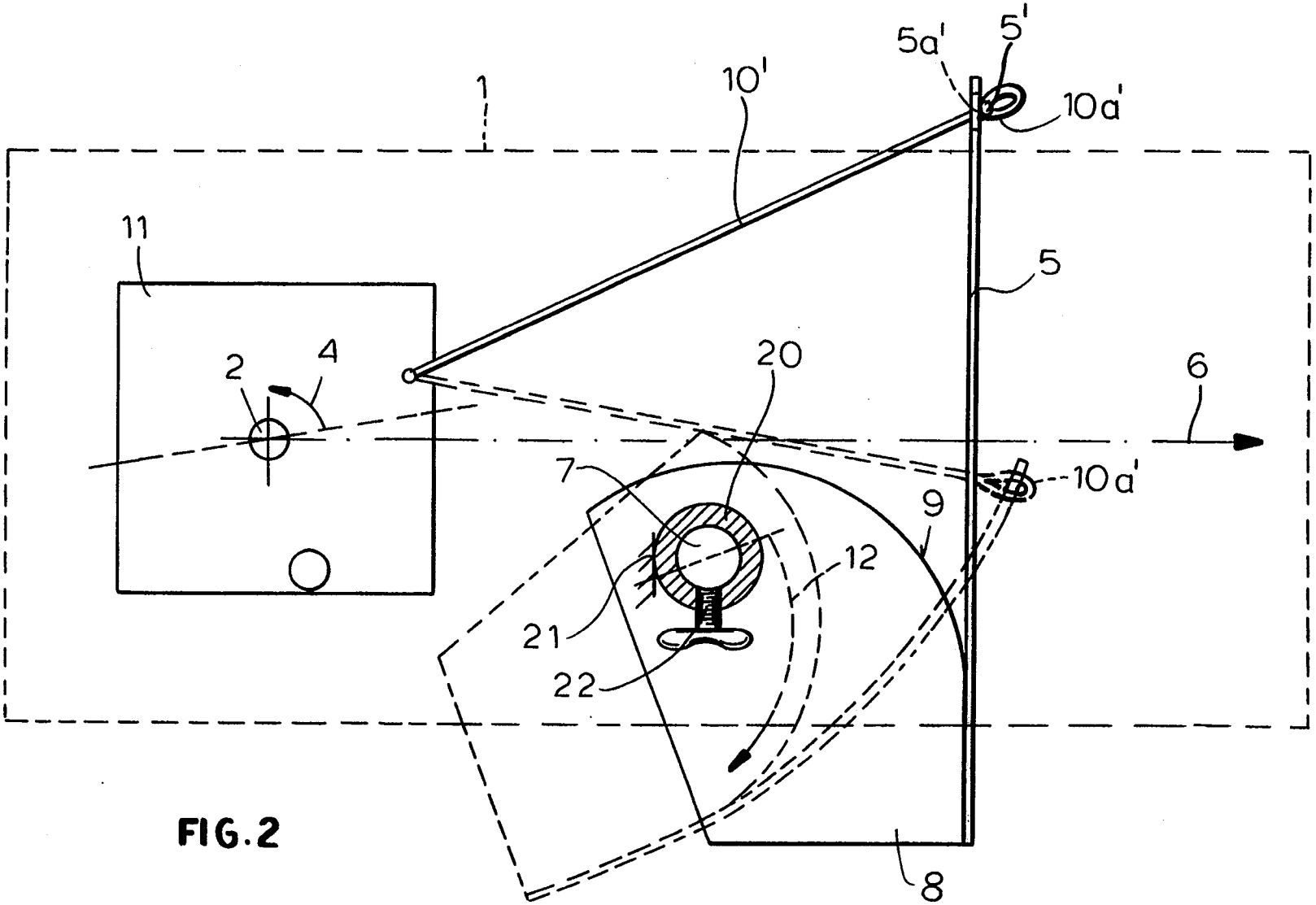
FIG. 2 is a view similar to FIG. 1 showing another embodiment.

As is also apparent from FIG. 1, the articulated connection between the leaf spring 5 and the lever 11 is a rigid bar 10 which is pivotally connected at 10*c* to the lever 11 and is formed, at its opposite end with a bend 10*a* beyond where the bar 10 passes through a hole 5*a* formed in the leaf spring. The bar 10 is further formed with a transverse pin 106 bridging across the hole and thus providing some play between the leaf spring and the bar so that the leaf spring can bend freely without deforming the bar 10 as the cam is swung from its solid line position shown in FIG. 1 to the broken line position thereof. In the embodiment of FIG. 2, the structure is similar to that of FIG. 1 except that the bar 10 is replaced by a cable 10' anchored by a pin 10*c'* to the lever 11 and having a loop 10*a'* engaging a pin 5' beyond an opening 5*a'* in the leaf spring 5. Here, therefore, an articulated connection between the leaf spring and the lever is provided by the cable 10'.

We claim:

1. A volume flow regulator for an air-conditioning or ventilating apparatus, comprising:

a duct traversed by a flow of air;

a flap swingable in said duct and acted upon by said flow of air, whereby a torque on said flap is determined by said flow;

a flap shaft carrying said flap and rotatable on said duct and having an end projecting beyond said duct;

a lever connected to said end of said flap shaft;

a leaf spring having one end articulately connected to said lever and another end;

a cam pivotable about a pivot axis transversely spaced from and parallel to said flap shaft and having a curved surface, said other end being connected to said cam whereby said leaf spring rolls upon said curved surface upon rotation of said cam, thereby altering prestress on said leaf spring and a direction of force application thereto; and means for releasably fixing a position of said cam about said pivot axis.

2. The volume flow regulator defined in claim 1, further comprising a connecting bar articulatedly connecting said lever with said one end of said leaf spring.

3. The volume flow regulator defined in claim 1, further comprising a connecting cable articulatedly connecting said lever with said one end of said leaf spring.

4. The volume flow regulator defined in claim 1 wherein said leaf spring extends substantially orthogonal to the flow of air in said duct in a relieved condition of said leaf spring.

5. The volume flow regulator defined in claim 4, further comprising a connecting bar articulatedly connecting said lever with said one end of said leaf spring.

6. The volume flow regulator defined in claim 4, further comprising a connecting cable articulatedly connecting said lever with said one end of said leaf spring.

* * * * *